US005653220A

United States Patent [19]

Velie et al.

[11] Patent Number: 5,653,220

[45] Date of Patent: Aug. 5, 1997

[54] BURN RATE CONTROL VALVE FOR GAS FIRED HEATERS

[75] Inventors: Wallance W. Velie, Alta Loma; Donald C. Haney, Rancho Cucamonga; Paul Biallas, Alta Loma, all of Calif.

[73] Assignee: Leland C. Scheu, Upland, Calif.

[21] Appl. No.: 376,893

[22] Filed: Jan. 20, 1995

[51] Int. Cl.[6] ..... F24C 3/00

[52] U.S. Cl. ..... 126/85 R; 126/52; 126/39 N; 251/206

[58] Field of Search ..... 431/89; 126/85 R, 126/39 N; 251/205, 206

[56] References Cited

U.S. PATENT DOCUMENTS

| | | | |
|---|---|---|---|
| 1,445,984 | 2/1923 | Wilkinson | 126/39 N X |
| 2,434,215 | 1/1948 | Mayer | 126/39 N |
| 2,497,139 | 2/1950 | Rumbaugh | 251/206 X |
| 3,494,599 | 2/1970 | Stupak, Jr. et al. | 263/19 |
| 3,529,584 | 9/1970 | Celaya | 126/39 N |
| 3,645,512 | 2/1972 | Dent et al. | 263/19 A |
| 4,244,349 | 1/1981 | Velie et al. | 126/110 |

FOREIGN PATENT DOCUMENTS

| | | | |
|---|---|---|---|
| 503473 | 4/1939 | United Kingdom | 431/89 |

*Primary Examiner*—Larry Jones

*Attorney, Agent, or Firm*—Jacobson, Price, Holman & Stern, PLLC

[57] ABSTRACT

A burn rate control valve for gas fired heaters in the form of a ¼ turn ball valve having two flow passages through the valve member in which one flow passage is for full gas flow and the other flow passage is smaller in diameter for low gas flow in order to provide a full burn rate or a low burn rate. The two passages are dimensioned and angularly related such that the larger or full burn rate passage essentially provides unrestricted flow when aligned with related ports or piping with the smaller or low burn rate passage being angularly related to the larger passage at an angle less than 90° in order to maintain a flow passageway when the ball valve member is moved to a position with the larger passage perpendicular to the associated ports. This angular relation assures that the smaller flow passage will be opened before the larger flow passage closes too much in order that the burner will not cease to operate and not provide a lower burn rate than intended.

5 Claims, 1 Drawing Sheet

BURN RATE CONTROL VALVE FOR GAS FIRED HEATERS

BACKGROUND OF THE INVENTION

1. Field of the Invention

The present invention generally relates to a burn rate control valve for gas fired heaters in the form of a ¼ turn ball valve having two flow passages through the valve member in which one flow passage is for full gas flow and the other flow passage is smaller in diameter for low gas flow in order to provide a full burn rate or a low burn rate. The two passages are dimensioned and angularly related such that the larger or full burn rate passage essentially provides unrestricted flow when aligned with related ports or piping with the smaller or low burn rate passage being angularly related to the larger passage at an angle less than 90° in order to maintain a flow passageway when the ball valve member is moved to a position with the larger passage perpendicular to the associated ports. This angular relation assures that the smaller flow passage will be opened before the larger flow passage closes too much in order that the burner will not cease to operate and not provide a lower burn rate than intended.

2. Description of the Prior Art

Gas fired heaters are generally well known and have been in use for many years. One desirable feature of such heaters is the ability to operate over a range of burn rates. Typical gas fired heaters of this type are disclosed in U.S. Pat. No. 3,494,599 issued Feb. 10, 1970 for Portable Forced Air Heater; U.S. Pat. No. 3,645,512 issued Feb. 29, 1972 for Forced Air Heater and U.S. Pat. No. 4,244,349 issued Jan. 13, 1981 for Portable Forced Air Heater. Gas fired heaters such as disclosed in the above patents have the ability to operate over a range of burn rates. The burn rate can be controlled by throttling the gas flow to the fuel orifice of such heaters. Two methods of controlling the burn rate is to (1) use a variable pressure regulator in the gas supply line or (2) use a valve in the fuel supply line.

While burn rate variation is known, the prior art does not include this invention in which a variable burn rate gas fired heater has the burn rate controlled by the unique structure of a ¼ turn ball valve incorporated into the gas fuel supply line between the gas pressure regulator and a fixed size heater fuel orifice.

SUMMARY OF THE INVENTION

An object of the invention is to provide a burn rate control valve for gas fired heaters utilizing a ¼ turn ball valve incorporated into the fuel system of a variable burn rate gas fired heater in which the ball valve includes dual flow passages through the ball with one flow passage being for full gas flow and the other passage being smaller for low gas flow thereby providing a full or maximum burn rate or a lower burn rate when the valve is used with a constant pressure gas supply and a fixed fuel orifice.

Another object of the invention is to provide a burn rate control valve in accordance with the preceding object in which the valve is incorporated into a gas heater plumbing system for supplying gas to a fixed heater fuel orifice from a gas pressure regulator which maintains constant gas pressure to the fuel orifice with the dual passage ball valve being incorporated into a gas flow line between the gas pressure regulator and the fixed heater fuel orifice.

A further object of this invention is to provide a burn rate control valve in accordance with the preceding objects in which the larger flow passage is used for full burn rate and the smaller flow passage through the valve is used for low burn rate with the larger flow passage being essentially nonrestrictive to gas flow from the pressure regulator to the fixed heater fuel orifice. The diameter of the larger flow passage is significant as the ball valve is moved to a position to achieve low burn rate with the unique arrangement resulting in the smaller flow passage through the ball valve opening by communicating with the gas flow line or inlet and outlet ports in the valve prior to the larger flow passage closing beyond a point that would restrict flow to the fuel orifice below the flow rate that is capable of maintaining the desired lower burn rate thereby preventing the valve from reducing flow to a point that would result in a lower burn rate than intended.

Still another object of the invention is to provide a burn rate control valve in which the larger passage in the valve and the smaller passage in the valve are of constant diameter throughout their length with the flow passages being at an angle relative to each other that is less than 90°.

A still further object of the invention is to provide a burn rate control valve in accordance with the preceding objects in which the port size in the valve is matched by the full rate, larger flow passage diameter with the smaller low rate flow passage diameter being less than the port size. The angular relation of the passages is such that the full burn rate passage does not restrict flow between an inlet port and an outlet port in the valve when in an open position aligned with the ports and the low burn rate passage is not restricted by the ports in the valve when the ball valve is in the 90° valve position, that is, the full rate flow passage being in a closed position perpendicular to the valve ports. During movement of the ball valve from the full rate flow open position toward a closed position for the larger passage, flow is never restricted through the passages that is less than the flow rate through the smaller low burn rate passage when the ball valve is in the 90° valve position.

Yet another significant object of the invention is to provide a burn rate control valve in accordance with the preceding objects in which the low rate flow capability for the ball valve depends upon the low flow passage size relative to the fuel orifice size with the ratio of the low flow passage diameter to the high flow passage diameter cooperating to prevent significant flow restriction when in a position with the high flow rate passage being aligned with the ports, in the 90° position and during movement of the ball valve from the 0° position with the high flow rate passage aligned with the ports to the position of the high flow rate passage in 90° relation to the ports.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
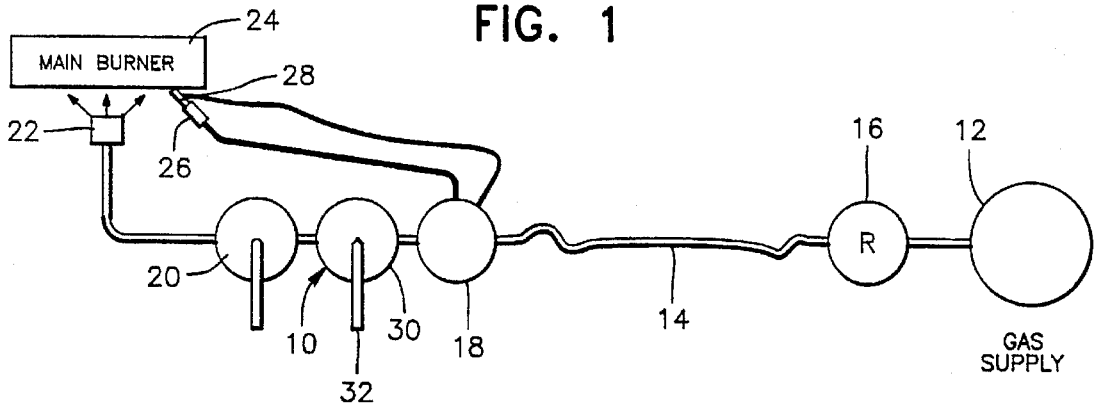
FIG. 1 is a schematic view of a gas fired heater system incorporating the burn rate control valve of the present invention illustrating the relationship of the valve to components of the gas plumbing or piping system.

FIG. 1 illustrates schematically the burn rate control valve 10 of the present invention and the relationship to other components of a gas fired heater including a gas supply source 12 to provide gas under a predetermined pressure with the gas pressure entering a piping system 14 which may be flexible pipe, tubing or the like. The supply gas pressure communicates with a pressure regulator 16 to provide a gas supply at a constant gas pressure. The piping or plumbing system 14 communicates with a pilot light and flame safety valve 18, the burn rate control valve 10, a main burner shut off valve 20, a fuel orifice 22 associated with a main burner 24 with all of these components being in serial relation. The pilot light and flame safety valve is associated with a pilot light 26 and a thermocouple 28 to assure operation of the main burner. Essentially, the burn rate control valve 10 of the present invention is oriented between a constant gas pressure supply source and a fixed size fuel orifice. As schematically illustrated in FIG. 1, the burn rate control valve 10 is a ¼ turn ball valve with a valve body or housing 30 to which the piping 14 is connected and a handle 32 is provided for rotating a ball valve member 34 ¼ turn as illustrated schematically in FIGS. 2–4.

Figure 2:
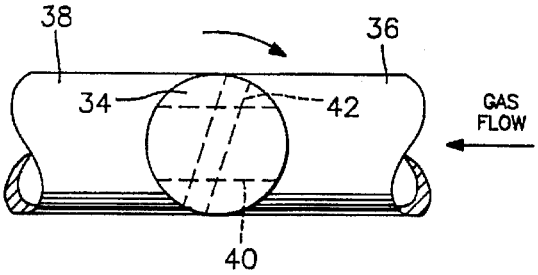
FIG. 2 is a schematic view of the ball valve illustrating the relation of the ball valve member to the inlet and outlet ports when the high or full rate flow passage is in alignment with the ports.
Figure 3:
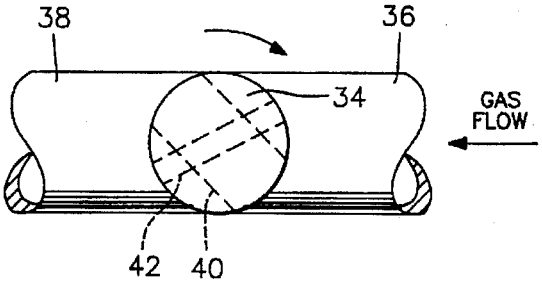
FIG. 3 is a schematic view of the valve member partially moved toward a 90° position and illustrating the relationship of the passages such that the smaller low flow rate passage communicates with the ports prior to the larger passage being closed too much in order that the flow rate between the ports will never be less than the flow rate capability of the smaller low rate flow passage.
Figure 4:
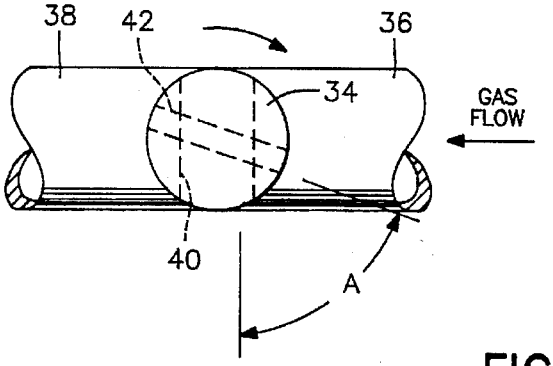
FIG. 4 is a schematic view of the burn rate control valve in a 90° position with the smaller low flow rate passage communicating with the ports for flow only through the low rate flow passage.

In FIGS. 2–4, the sequential position of the ball valve member 34 is illustrated and schematically related to an inlet flow port 36 and an outlet flow port 58 which are actually in the valve housing and connected with the piping or plumbing system 14 in a conventional manner. The ball valve member 34 is provided with dual passages including a larger diameter full rate flow passage 40 and a smaller diameter low rate flow passage 42 with each of the passages extending diametrically of the ball valve member and oriented in intersecting relation in a specific angular relation as described in detail hereinafter. The diameter of the full rate flow passage 40 is such that when it is in the position illustrated in FIG. 2 in alignment with the ports 36 and 38, full gas flow can occur through the port 36, through the passage 40 and the port 38 to the fuel orifice 22 without any restriction.

FIG. 3 illustrates a partial rotational movement of the ball valve member 34 to a position in which the passage 40 has partially moved out of alignment with the ports 36 and 38 but have not been completely closed off from the ports so that gas flow still occurs through the passage 40 but to a substantially less volume as compared to the position illustrated in FIG. 2. Also, in this position as illustrated in FIG. 3, the smaller passage 42 is in communication with the ports 36 and 38 for flow of gas through the passage 42. The angle A between the passages 40 and 42 is less than 90° and is arranged such that the smaller passage 42 is fully communicated with the ports 36 and 38 prior to the passage 40 being closed off from the ports 36 and 38 thereby assuring that as the full rate flow passage 40 moves to a closed position, the gas flow rate through the ball valve will not be restricted to less than the flow rate capacity of the low flow rate passage 42.

FIG. 4 illustrates the ball valve member 34 in a 90° relation to that illustrated in FIG. 2 in which the full rate flow passage 40 is closed off from the flow ports 36 and 38. In the 90° fully closed position of the full rate flow passage 40, as illustrated in FIG. 4, the smaller low flow rate passage 42 is in communication with the ports 36 and 38 thus restricting the flow rate of gas to a volume permitted by the diameter of the flow passage 42 without any restrictions between the passage 42 and the ports 36 and 38.

When closing the ball valve member 34 to change the flow rate from the full rate flow position of FIG. 2 to the low rate flow position of FIG. 4, the smaller flow rate passage 42 must open before the larger flow rate passage 40 closes too much as illustrated in the partially rotated position illustrated in FIG. 3. Otherwise, the burner will cease to operate and/or be capable of a lower burn rate than intended. In order to prevent excessive flow restriction, the flow passages in the ball valve 34 must be at an angle A to each other which is less than 90°. The ball valve member requires matching of port size, full rate flow passage diameter, low rate flow passage diameter and angle A included between the passages to obtain the following results. (1) The full rate flow passage 40 does not restrict flow when aligned with the ports 36 and 38. (2) The low rate flow passage 42 is not restricted by the ports in the 90° valve position as illustrated in FIG. 4. (3) During closure, the flow rate is not restricted to less than that when the valve member is in the 90° position as illustrated in FIG. 3.

Figure 5:
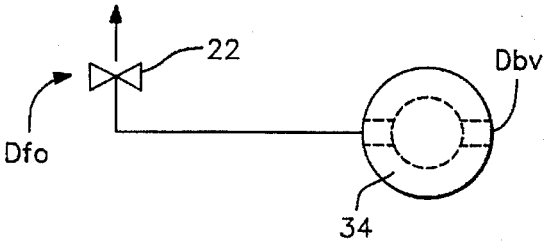
FIG. 5 is a schematic view illustrating the approximate ratio of fuel orifice diameter to the diameter of the smaller low rate flow passage in the ball valve to achieve the desired ratio of high to low burn rate.
Figure 6:
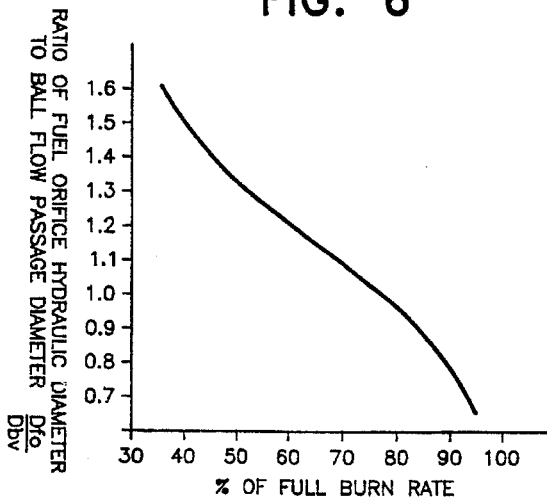
FIG. 6 is a graphic view illustrating the ratio of the fuel orifice hydraulic diameter to the ball valve flow passage diameter for various burn rate less than the full flow burn rate.

The low rate flow for the burn rate control valve 10 depends upon the low rate flow passage size relative to the fuel orifice size. FIGS. 5 and 6 illustrate this relationship with the ratio of the low flow rate passage diameter to the high rate flow passage diameter being important to prevent significant flow restriction in the fully open position. FIG. 5 illustrates the approximation of the ball valve flow passage diameter for various burn rates and FIG. 6 illustrates graphically the percentage of full burn rate obtained by the ratio of the fuel orifice hydraulic diameter to the full rate flow passage diameter when the valve member is in fully open position without restrictions to flow through the ports as illustrated in FIG. 2.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A burn rate control valve for the burner of a gas fired heater, said valve including a ¼ turn valve member communicating with a single inlet port and a single outlet port in a pressurized gas supply system, said valve member including a full burn rate flow passage extending diametrically thereof and enabling gas flow therethrough to said burner when the full rate flow passage is aligned with both ports, said full rate flow passage having a cross sectional area substantially equal to the size of the ports to enable gas flow between the ports without restriction, said valve member including a low burn rate flow passage extending diametrically thereof in angular, intersecting relation to said full rate flow passage, said low rate flow passage having a cross sectional area less than the full rate flow passage to enable unrestricted flow between the ports and to said burner when in full communication therewith at a rate less than that permitted by the full rate flow passage, said full rate flow passage being closed off from both ports and burner when the valve member is in 90° relation to the ports, said low rate flow passage being in communication with both ports when the valve member and full rate flow passage is in 90° relation to the ports, the angular relation between the flow rate passages being such that the low flow rate passage will communicate with both ports for unrestricted flow between the ports through the low rate flow passage prior to the full rate flow passage being closed off from both ports during movement of the valve member from a position with the full rate flow passage in alignment with both ports to a position with the full rate flow passage in 90° relation thereto.

2. The burn rate control valve as defined in claim 1 wherein said valve member is a ball valve and the included angle between the passages therethrough is less than 90°.

3. The burn rate control valve as defined in claim 1 wherein, said gas supply system comprises a pressure regulator means communicated with a pressurized gas supply source with the pressure regulator means communicating with said valve and a fuel orifice means communicating with said valve and supplying gas to said burner, said burn rate control valve flow passages providing full rate flow and low rate flow of gas to the fuel orifice means.

4. The burn rate control valve as defined in claim 3 wherein the ports in the valve and the passages in the valve member are sized and angled in relation to each other to prevent excessive flow restriction during movement of the valve member through ¼ turn.

5. A gas supply system for the burner of a gas fired heater comprising gas piping interconnecting said burner and a pressurized gas supply, flow rate control means interposed in said gas piping, said flow rate control means including a valve having two flow passages therethrough for high and low burn rate flow to said burner, said flow passages extending diametrically through the valve at an angle other than 90° to prevent flow restriction to a volume less than the flow capacity of the passage for low burn rate flow during the movement of the valve to a position closing the high burn rate flow passage, said passage being in angular intersecting relation at an angle less than 90° such that the high burn rate flow passage will not restrict flow through the flow rate control means when fully communicating with the gas piping and the low burn rate flow passage is fully communicated with the gas piping before the high burn rate flow passage is closed in relation to the gas piping.

* * * * *